US005535820A

United States Patent [19]

Beagle et al.

[11] Patent Number: 5,535,820

[45] Date of Patent: Jul. 16, 1996

[54] METHOD FOR ASSEMBLING A HEAT EXCHANGER

[75] Inventors: Gerald R. Beagle, Blissfield, Mich.; Dallas L. Guilford, Delta, Ohio; Charles E. Southward, Adrian; Dale C. Bellman, Pittsford, both of Mich.

[73] Assignee: Blissfield Manufacturing Company, Blissfield, Mich.

[21] Appl. No.: 503,649

[22] Filed: Jul. 18, 1995

[51] Int. Cl.[6] ..... F28D 1/047; F28F 1/32

[52] U.S. Cl. ..... 165/150; 165/151; 165/DIG. 498; 29/890.047

[58] Field of Search ..... 165/150, 151, 165/DIG. 498; 29/890.044, 890.047

[56] References Cited

U.S. PATENT DOCUMENTS

| | | | |
|---|---|---|---|
| 2,092,170 | 9/1937 | Kritzer et al. | 165/151 X |
| 2,462,511 | 2/1949 | Kramer | 29/157.3 |
| 3,153,443 | 10/1964 | Kritzer | 165/67 |
| 3,433,300 | 3/1969 | Pasternak | 165/151 |
| 3,780,799 | 12/1973 | Pasternak | 165/150 |
| 4,799,540 | 1/1989 | Pietzcker | 165/76 |
| 4,966,230 | 10/1990 | Hughes et al. | 165/150 |
| 5,033,190 | 7/1991 | Gray | 29/890.044 |
| 5,063,117 | 11/1991 | Suda et al. | 428/610 |
| 5,070,608 | 12/1991 | Gray | 29/890.044 |
| 5,072,789 | 12/1991 | Usui et al. | 165/134.1 |

*Primary Examiner*—Allen J. Flanigan
*Attorney, Agent, or Firm*—Gary M. Hartman; Domenica N. S. Hartman

[57] ABSTRACT

An improved method is provided for assembling a heat exchanger by mechanically joining one or more pairs of tubes with fins arranged in a fin pack. The method involves a novel external expansion technique that is performed between pairs of tubes and internally of the fin pack, in a manner that enhances the mechanical joint strength and metal-to-metal contact between the tubes and fins of the heat exchanger, while enabling the assembly process to be reduced to a single operation. Consequently, the method of this invention avoids the shortcomings of internal expansion techniques, and provides a significant improvement over prior art external expansion techniques. The method of this invention also yields a novel heat exchanger configuration, in which only facing surfaces of the tube within the fin pack are deformed in order to expand and mechanically join the tube to the fins. Finally, the present invention also encompasses a unique expansion tool for externally expanding the tube portions within the fin pack.

27 Claims, 3 Drawing Sheets

METHOD FOR ASSEMBLING A HEAT EXCHANGER

BACKGROUND OF THE INVENTION

1. Field of the Invention

The present invention relates to an improved method for joining tubes of a heat exchanger to an array of fins for the purpose of assembling a heat exchanger. More particularly, this invention relates to an improved method for mechanically joining tubes and fins, in which the tubes are deformed using an external expansion technique that does not involve intrusion into the tube, but instead entails the use of an expansion tool adapted to be inserted between tubes within the tube and fin assembly.

2. Description of the Prior Art

Heat exchangers are widely used in various industries in the form of radiators for cooling motors and engines, condensers and evaporators for use in air conditioning systems, and heaters. In their most simple form, heat exchangers include one or more passages through which a fluid flows while exchanging heat with the environment surrounding the passage. In order to efficiently maximize the amount of surface area available for transferring heat between the environment and fluid, the design of a heat exchanger is typically of a tube-and-fin type containing a number of tubes which thermally communicate with high surface area fins. The fins enhance the ability of the heat exchanger to transfer heat from the fluid to the environment, or vice versa.

Various heat exchanger designs are known in the prior art. Design variations include the manner in which the fluid passage is constructed and the type of fin used. For example, the passage may be composed of a single and integrally-formed ("continuous") serpentine tube that traverses the heat exchanger in a circuitous manner, or a number of discrete parallel tubes joined, typically brazed, to and between a pair of headers. An advantage with continuous serpentine tubes is avoiding the necessity to form numerous leak-proof joints between the tubes and headers and between the tubes and their interconnecting return bends (elbows) and connector tubes. The fins may be provided in the form of panels having apertures through which the tubes are inserted, or in the form of centers that can be positioned between adjacent pairs of tubes.

Conventionally, heat exchangers are manufactured by joining the tubes and fins using a brazing operation or a mechanical expansion technique. Mechanical expansion techniques rely solely on the mechanical joining of the components of the heat exchanger to ensure the integrity of the heat exchanger. As a result, advantages of mechanical expansion assembly techniques include good mechanical strength and avoidance of joining operations that require a furnace operation. However, disadvantages of such techniques include inferior thermal performance due to inadequate contact between the tubes and fins, resulting in reduced heat transfer efficiency. Accordingly, improvements in mechanical expansion techniques have often been directed to ways in which the integrity of the tube-to-fin joint can be improved.

Conventional mechanical expansion methods can generally be categorized as being external or internal operations. Internal expansion techniques typically entail forcing an expansion tool into the tubes to physically force the walls of the tubes outward and into engagement with the fins. In contrast, external expansion techniques have generally entailed deforming the tubes with an expansion tool that impacts or presses the tubes into engagement with the fins. While internal expansion methods tend to be characterized by enhanced joint strength and a lower resistance to heat transfer, the intrusion of a tool into the tubes is generally undesirable from the standpoint of the potential for introducing contaminants into the tubes, necessitating post-forming cleaning operations. Furthermore, deformation of the tube walls raises the potential for excessive wall thinning, and therefore reduced strength. Finally, internal expansion methods are not well suited for use with heat exchangers formed with a serpentine tube.

From the above, it can be appreciated that it would be advantageous if an improved method were available for mechanically joining the tubes and fins of a heat exchanger. Such a method would preferably result in joint strength comparable to internal expansion methods, but rely entirely on an external expansion technique so as to avoid the disadvantages of internal expansion methods, including the potential for contamination and wall thinning. A preferred technique would also be well suited for use on heat exchanger designs incorporating a serpentine tube configuration.

SUMMARY OF THE INVENTION

It is an object of this invention to provide a mechanical joining method for assembling a heat exchanger unit, in which an external expansion technique is used to form a mechanical joint between a tube and fin solely through a forming operation performed externally of the tube, but within the heat exchanger assembly.

It is another object of this invention that such a method promotes joint strength and reduces resistance to heat transfer between the tube and fin.

It is still another object of this invention that the method is suitable for assembling heat exchangers employing a serpentine tube formed to yield one or more rows of tubes.

It is yet another object of this invention that such a method is capable of being performed as a one-step assembly operation.

It is a further object of this invention that such a method yields a unique heat exchanger configuration.

It is still a further object of this invention to provide an expansion tool specially adapted for use in the method of this invention.

In accordance with a preferred embodiment of this invention, these and other objects and advantages are accomplished as follows.

According to the present invention, an improved method is provided for assembling a heat exchanger unit that is suitable for use a radiator for cooling a motor or engine, a condenser or evaporator for use in air conditioning systems, or a heater. The method involves a novel external expansion technique that enhances the mechanical joint strength and metal-to-metal contact between the tubes and fins of the heat exchanger, while enabling the assembly process to be reduced to a single operation. Consequently, the method of this invention avoids the shortcomings of internal expansion techniques, and provides a significant improvement over prior art external expansion techniques.

The method of this invention generally includes forming a number of fins for assembly with one or more tubes having two substantially parallel tube portions. Each of the fins is formed to include one or more apertures having an oblong shape defining an intermediate region and oppositely-disposed end regions, in which the lateral width of the end regions is greater than the lateral width at the intermediate region—what can generally be termed a "dog bone" shape. The tube portions are formed to include an elbow therebetween. The elbow has a width less than the lateral width of the intermediate region of the apertures, while each of the tube portions is sized to be received in one of the end regions of the aperture. Together, the tube portions and their included elbow are configured to be received within a single aperture.

The fins are then arranged to form a fin pack, i.e., an array of substantially parallel fins, such that their apertures are aligned to form an aggregate passage through the fin pack. The tube portions are then inserted into the aggregate passage, such that the elbow enters the aggregate passage first and such that each of the tube portions is received within a corresponding one of the end regions of each of the apertures. As installed, the tube portions have surfaces that face each other within the aggregate passage. Finally, the tube portions are expanded against their respective end regions through the application of a force that causes the facing surfaces of the tube portions to be deformed, resulting in the tube portions being mechanically secured to the fins. More specifically, an expansion tool is inserted into the intermediate portion of the aperture and between the tube portions, and the tube portions are urged apart with the tool such that their facing surfaces are deformed to the extent that the tube portions acquire a D-shaped cross-section. Preferably, only the tube portions are deformed such that flow through the heat exchanger is not unnecessarily restricted.

Advantageously, the above assembly method enables the insertion of the tube portions into the fin pack and the expansion of the tube portions to be performed in a single operation. In a preferred embodiment, the expansion tool is inserted into the fin pack simultaneously with the tube portions, and expansion of the tubes occurs as the expansion tool is withdrawn from the fin pack. Accordingly, the method of this invention is greatly simplified in comparison to prior art assembly methods used to achieve comparable joint strength and integrity, such as internal expansion techniques and braze operations.

From the above, it can be appreciated that the method of this invention yields a novel heat exchanger configuration. In particular, the heat exchanger is generally characterized by pairs of tube portions received within the aggregate apertures formed by the apertures of the fins. Each pair of tube portions is disposed within an aggregate passage, such that each tube portion is received within a corresponding one of the end regions of the apertures. Finally, only the facing surfaces of the tube portions within the aggregate passage are deformed in order to expand and mechanically join the tube portions with the fins. In other words, a heat exchanger produced in accordance with this invention is not characterized by an internally expanded tube or fins that have been externally compacted against the tubes. Furthermore, the heat exchanger of this invention can incorporate a continuous serpentine tube, in which the tube portions and elbow are part of an integrally-formed fluid passage through the fin pack, yet each tube portion is individually secured to each of the fins in the fin pack to yield a heat exchanger of high mechanical integrity. Use of a single continuous serpentine tube simplifies assembly in comparison to prior art assembled serpentine tubes that require multiple elbows and connectors that must be mechanically or metallurgically joined to a number of tube portions arranged in parallel.

Finally, the present invention encompasses a unique expansion tool for externally expanding the tube portions within the fin pack. Such a tool preferably includes an elongate portion and a rod received within a longitudinal passage formed in the elongate portion. A pair of cantilevered members is disposed at one end of the elongate portion, with the cantilevered members being adapted to expand in opposite lateral directions through axial motion of the rod. As configured in the manner described, the expansion tool is particularly well suited for being inserted into the intermediate region of the apertures formed in the fins, and expanding the tube portions to a degree sufficient to mechanically join the tube portions with the fins. As such, the expansion tool uniquely enables the one-step assembly operation described previously, in which the tube portions and the tool are simultaneously inserted into the aggregate aperture of the fin pack.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE PREFERRED EMBODIMENT

Figure 1:
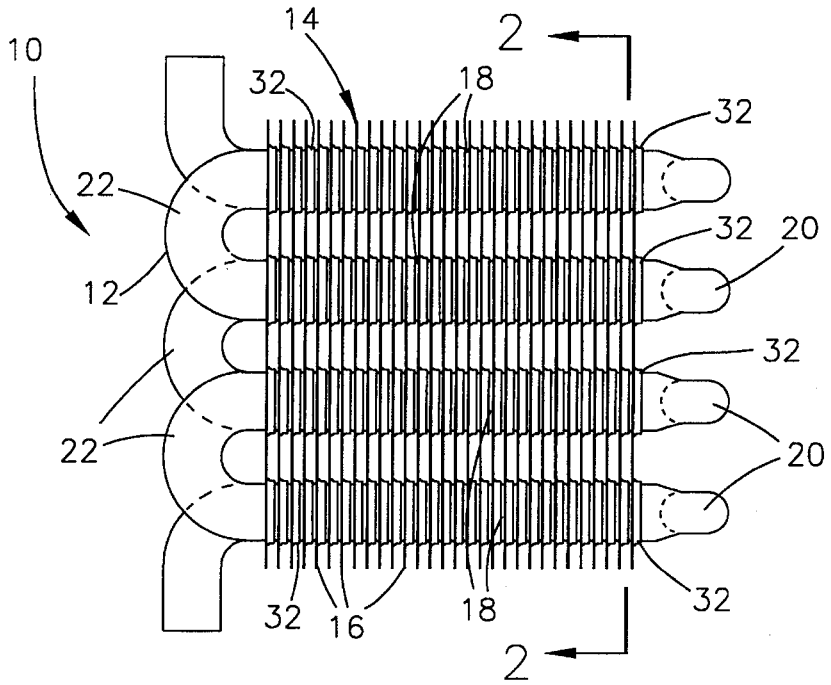
FIG. 1 is a side view of a serpentine heat exchanger unit representative of a heat exchanger configuration in accordance with a preferred embodiment of this invention.
Figure 2:
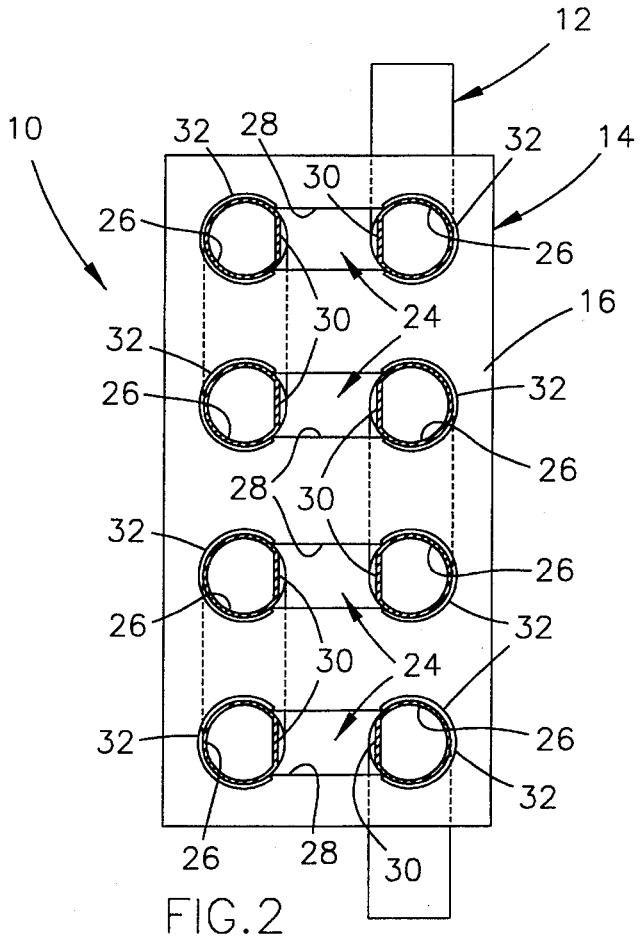
FIG. 2 is an end view along line 2—2 of FIG. 1.

An improved method is provided for assembling and mechanically joining a heat exchanger 10 of the type shown in FIGS. 1 and 2. Such a heat exchanger 10 is generally characterized by a serpentine tube 12 disposed within a fin pack 14 composed of a number of substantially parallel fins 16. The tube 12 includes a number of substantially parallel tube portions 18, shown as being paired together and interconnected with leading elbows 20, with each pair of tube portions 18 being interconnected with other pairs of tube portions 18 by at least one trailing elbow 22. The tube 12 is shown as having a circular cross-section, though it is foreseeable that other cross-sectional shapes could be employed. The tube 12 and fins 16 can be formed from any suitable material, such as but not limited to copper and aluminum. The tube 12 is typically formed as an extruded straight tube that has been formed to attain the desired serpentine shape using a suitable bending technique, while the fins 16 may be formed by a stamping operation.

While the external expansion method of this invention will be described in the context of the heat exchanger unit 10 shown in FIGS. 1 and 2, those skilled in the art will recognize that the teachings of this invention are also applicable to heat exchanger units that may differ significantly in appearance. For example, though only a single serpentine tube 12 is shown in the Figures, multiple serpentine tubes could be used in the construction of the heat exchanger 10. Furthermore, though the heat exchanger 10 is shown as being composed of tube portions 18 arranged in two columns and four rows, a heat exchanger can be formed in accordance with this invention to have any number of tube rows and columns.

As seen in FIG. 2, each pair of tube portions 18 is received within an aperture 24 formed in each of the fins 16. More particularly, the tube portions 18 are received within a circular-shaped end region 26 of each aperture 24, with an intermediate rectangular region 28 of each aperture 24 being present between the tube portions 18. As is apparent from FIG. 2, the lateral width of each end region 26 is greater than the lateral width of the rectangular region 28. The apertures 24 depicted in FIG. 2 have been referred to within the industry as "dog bone" apertures, and their particular shape promotes the amount of contact between the tube portions 18 and the fins 16, such that heat transfer between the tube 12 and fin pack 14 is also promoted.

In order for the serpentine tube 12 to be assembled with the fin pack 14, the leading elbows 20 must have a somewhat flattened cross-section, as depicted in FIG. 1, in order for the elbows 20 to pass through the rectangular regions 28 of the apertures 24. In contrast, the trailing elbows 22 of the tube 12 need not be deformed, in that only the leading elbows 20 and the tube portions 18 must be capable of passing through the apertures 24 during assembly of the heat exchanger 10, as will be discussed in greater detail below. As such, the trailing elbows 22 may have a width greater than the lateral width of the rectangular regions 28 of the apertures 24, such that the trailing elbows 22 cannot be inserted through the apertures 24.

Figure 3:
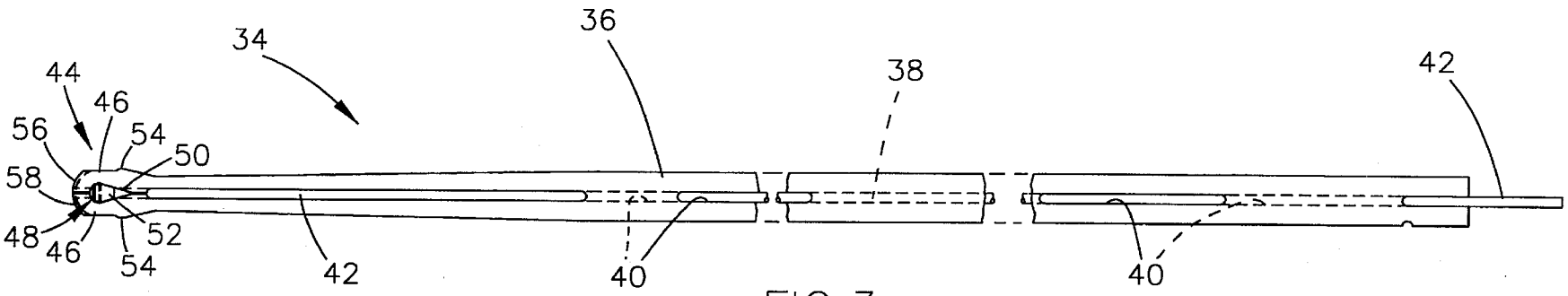
FIG. 3 is a side view of an expansion tool in accordance with a preferred aspect of this invention.
Figure 4:
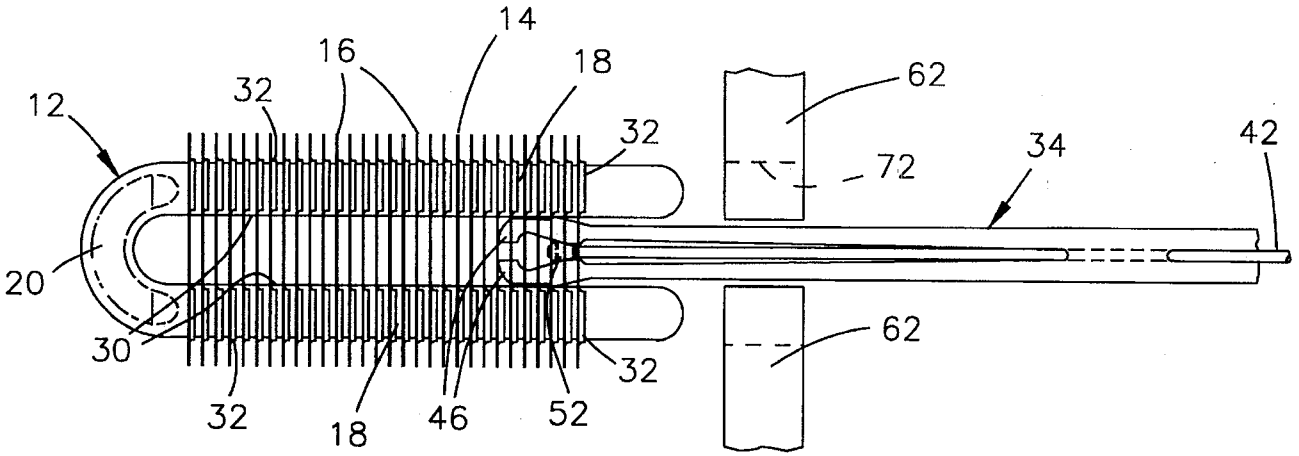
FIG. 4 illustrates the use of the tool of FIG. 3 with the serpentine heat exchanger of FIGS. 1 and 2.

As seen in FIG. 2, facing surfaces 30 of each pair of tube portions 18 are deformed in order to expand the tube portions 18 and thereby mechanically join the tube 12 with the fins 16. More specifically, the tube portions 18 are deformed to the extent that the cross-section of the tube portions 18 is substantially D-shaped. By deforming the tube portions 18 in this manner, the tube portions 18 are each forced into contact with preformed collars 32 surrounding the circular regions 26, shown in FIG. 1. The manner in which the facing surfaces 30 are deformed to secure the tube 12 to the fin pack 14 is a primary feature of this invention. In particular, the present invention encompasses a process by which the tube portions 18 are externally expanded internally of the fin pack 14, with only the tube portions 18 being deformed to the extent necessary to produce a reliable mechanical joint between each tube portion 18 and the fins 16. The external expansion method made possible by this invention is generally illustrated in FIG. 4, with a preferred expansion tool 34 for deforming the facing surfaces 30 of the tube portions 18 being shown in FIG. 3, and a suitable assembly station 60 being represented in FIG. 5.

The expansion tool 34 of this invention generally has an elongate body 36 and a rectangular cross-section through which a passage 38 is formed. Disposed within the passage 38 is a rod 42 that serves to actuate the tool 34, as will be described below. Because the expansion tool 34 must generally be sufficiently long to extend through the fin pack 14, the passage 38 is preferably formed by machining or otherwise providing alternative slots 40 on opposite sides of the tool 34, such that the slots 40 overlap to form the continuous passage 38 for the rod 42. Due to the length of the tool 34 being much greater than its cross-section, the body 36 of the tool 34 is preferably formed from a tough material, such as a steel alloy having an approximate hardness of 30 Rc and flame hardened on its work surfaces.

The tool 34 terminates with an expandable end 44 composed of a pair of cantilevered jaws 46 that define a cavity 48 therebetween. The distal ends of the jaws 46 preferably cooperate to form an arcuate convex surface 56, as shown in FIG. 3, in which a concave channel 58 is formed. The channel 58 is preferably sized to be complementary to the diameter of the leading elbow 20 of the tube 12. Each of the jaws 46 is also formed to include a ramp 50 that faces the cavity 48 in the manner shown in FIG. 3. A wedge 52 is shown as being threaded onto the end of the rod 42, so as to be disposed within the cavity 48 between the jaws 46 and engaged with the ramps 50. In this manner, retraction of the rod 42 through the passage 38 causes the wedge 52 to force the jaws 46 apart, thereby expanding the end 44 of the tool 34 in opposite lateral directions. Bearing surfaces 54 for engagement with the tube portions 18 are formed on the jaws 46 opposite their ramps 50, such that the cavity 48 and the wedge 52 are between the bearing surfaces 54 and the distal ends of the jaws 46. To reduce friction, prevent galling and promote the life of the tool 34, the bearing surfaces 54 are preferably harder than the remainder of the tool 34, such as by heat treating the bearing surfaces 54 or coating the surfaces 54 with a wear-resistant coating, such as titanium nitride.

Figure 5:
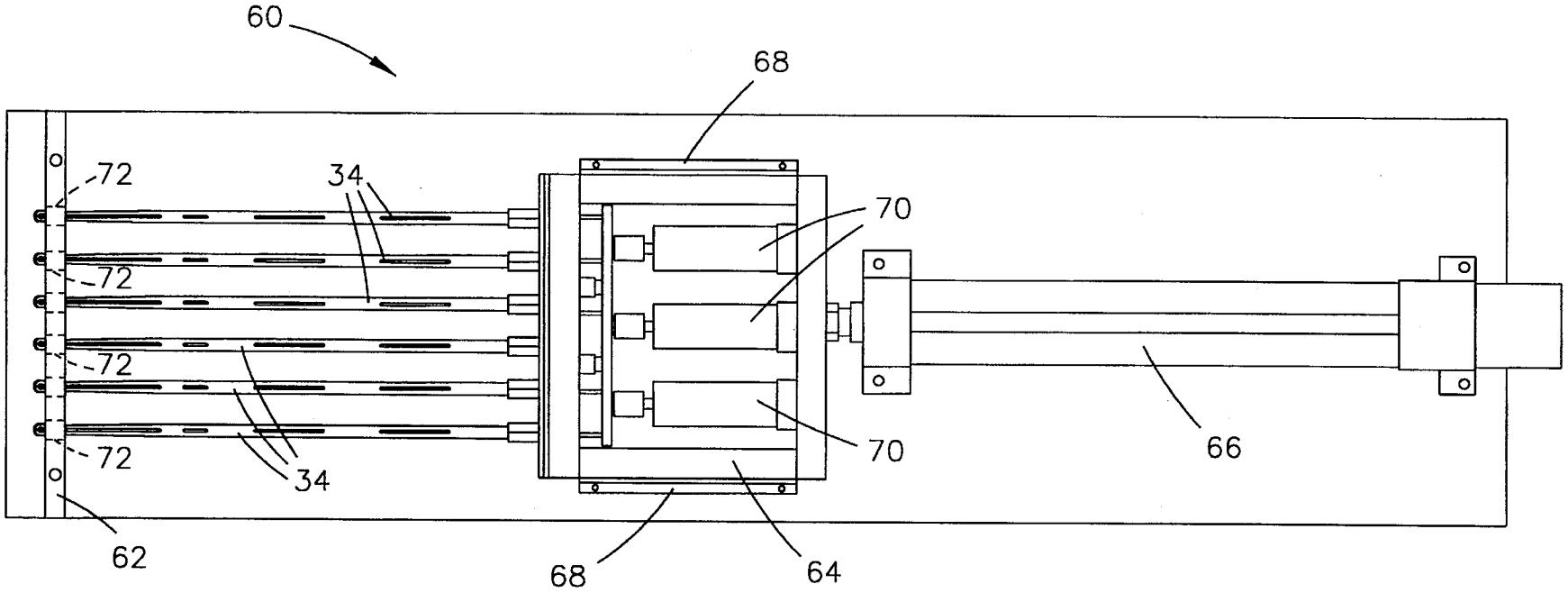
FIG. 5 illustrates a heat exchanger assembly station suitable for use in the practice of this invention.

Using the expansion tool 34 of FIG. 3, the assembly and joining of the heat exchanger assembly 10 are preferably performed as follows, with reference to the assembly station 60 shown in FIG. 5. After forming the tube 12 and fins 16, the fins 16 are stacked in a conventional manner so as to generally result in the fin pack 14 shown in FIG. 1, with the apertures 24 being aligned to form an aggregate passage through the fin pack 14. The tube 12 is then positioned on the assembly station 60 by being inserted, trailing elbow 22 first, through openings 72 in a guide plate 62 through which the expandable ends 44 of a corresponding number of expansion tools 34 extend. In doing so, a tool 34 is inserted between each of the pairs of tube portions 18, until the convex surface 56 of each tool 34 engages the interior of its corresponding leading elbow 20 of the tube 12, with each channel 58 receiving the diameter of the elbow 20. In this manner, the bearing surface 54 formed on each jaw 46 of the tools 34 is spaced apart from the leading elbow 20, and is disposed adjacent one of the tube portions 18. Furthermore, the leading elbows 20 of the tube 12 are disposed adjacent the guide plate 62, against which the fin pack 14 is positioned for assembly with the tube 12.

The tools 34 are shown as being mounted to a frame 64, such that the tube 12, the tools 34 and the frame 64 are stroked relative to the guide plate 62 by a primary cylinder 66. The frame 64 resides between a pair of guide rails 68, and includes secondary cylinders 70 associated with each of the tools 34. The secondary cylinders 70 serve to actuate the respective rods 42 of their tools 34 for the purpose of expanding and collapsing the pairs of jaws 46 of the tools 34. The tube 12 and the expansion tools 34 are then simultaneously moved toward the fin pack 14 with the primary cylinder 66, such that the tube 12 and the tools 34 simultaneously enter the apertures 24 in the fins 16. In this manner, the tube portions 18 and the tools 34 are received within the circular regions 26 and rectangular regions 28, respectively, of the apertures 24. Insertion continues until the leading elbows 20 exit the opposite side of the fin pack 14 to achieve the general appearance shown in FIGS. 1 and 4. At this point, the tube 12 is physically held within the fin pack 14 by an interference fit between the tube portions 18 and the circular regions 26 of the apertures 24, and the rods 42 of the expansion tools 34 are retracted by the secondary cylinders 70 in order to actuate the wedges 52, thereby engaging the bearing surfaces 54 with the facing surfaces 30 of the tube portions 18. Thereafter, the expansion tools 34 are withdrawn from the apertures 24 with the primary cylinder 66, such that the facing surfaces 30 of the tube portions 18 are deformed by the bearing surfaces 54 as the tools 34 are retracted, as depicted in FIG. 4. Because the bearing surfaces 54 of the tools 34 never engage the leading elbows 20, these elbows 20 are not deformed by the tools 34. Furthermore, it is preferable to disengage the bearing surfaces 54 from the tube portions 18 prior to encountering the trailing elbows 22, so as not to deform these elbows 22. Doing so maximizes the mechanical strength of the joint between the tube portions 18 and the fins 16, while avoiding unnecessarily collapsing the elbows 20 and 22, which would restrict flow through the tube 12.

From the above, it can be appreciated that the method of this invention involves a single operation for both installing and securing a serpentine tube 12 to a fin pack 14. Specifically, installation and external expansion of the tube 12 and its tube portions 18 are achieved within a single cycle of the primary cylinder 66. Consequently secondary operations, such as a brazing operation, an internal expansion of the tube portions 18, or an external operation on the fins 16, is completely unnecessary with the present invention. Because a serpentine tube 12 can be assembled with this method, it is unnecessary to perform subsequent leak tests that are conventionally required with brazed heat exchanger assemblies and with heat exchangers assembled with tubes that have been brazed or mechanically joined with their elbows. Accordingly, after assembly, the heat exchanger 10 of this invention is essentially ready for use.

The assembly method of this invention is also advantageous in that it yields a novel heat exchanger configuration. In particular, the heat exchanger 10 is generally characterized by the tube 12 being assembled with the fins 16, each having one or more oblong-shaped apertures 24 specifically shaped to receive the pairs of tube portions 18. The tube portions 18 are disposed in the aggregate passage formed when the apertures 24 are aligned, with only the facing surfaces 30 of the tube portions 18 being deformed in order to expand and mechanically join the tube 12 with the fins 16. In other words, the heat exchanger 10 produced in accordance with this invention is not characterized by an internally expanded tube that has been compacted against the fins. Furthermore, the tube 12 can be an integrally formed serpentine tube composed of substantially parallel and straight tube portions 18 that are integral with the elbows 20 and 22 to form a continuous fluid passage through the fins 16.

In addition, and contrary to prior art heat exchangers assembled by mechanically joining a serpentine tube with fins, more than two rows of tube portions 18 can be present in the heat exchanger 10 of this invention, since mechanical joining does not rely on a force being applied external of the fin pack 14. In the prior art, the presence of more than two rows of tubes would prevent the tubes from being sufficiently deformed to secure the inner row or rows of tubes with their adjacent fins.

Another feature of this invention is the use of a unique expansion tool 34 for externally expanding the tube portions 18 within the fin pack 14. The tool 34 is configured to be received within the rectangular region 28 of the apertures 24 between the tube portions 18, such that the tool 34 is adapted to expand the tube portions 18 internally of the fin pack 14, and to a degree sufficient to mechanically join the tube portions 18 with the fins 16. As such, the expansion tool 34 uniquely enables the one-step assembly operation described previously, in that the assembly and joining steps are not performed as discrete operations using separate equipment.

While our invention has been described in terms of a preferred embodiment, it is apparent that other forms could be adopted by one skilled in the art. For example, various materials could be used for the tube 12 and fins 16, the shapes of the tube 12 and fins 16 and the overall appearance of the heat exchanger 10 could be other than that shown in the Figures, and additional processing and assembly steps could be employed. Accordingly, the scope of our invention is to be limited only by the following claims.

The embodiments of the invention in which an exclusive property or privilege is claimed are defined as follows:

1. A method for joining two substantially parallel tube portions to a fin pack so as to form a heat exchanger unit, the method comprising the steps of:

forming fins for assembly with the tube portions such that an aperture is formed in each fin, each of the apertures having an oblong shape defining an intermediate region and oppositely-disposed end regions, each aperture having a lateral width at each of the end regions that is wider than a lateral width at the intermediate region;

forming the tube portions to include an elbow therebetween, the elbow having a width less than the lateral width of the intermediate region of the apertures, the tube portions and elbow defining a continuous fluidic passage;

arranging the fins to form the fin pack such that the apertures of the fins are aligned to form an aggregate passage through the fin pack;

inserting the tube portions into the aggregate passage such that the elbow enters the aggregate passage first and such that each of the tube portions is received within a corresponding one of the end regions of each of the apertures, the tube portions having facing surfaces within the aggregate passage; and externally expanding the tube portions against their respective end regions by forcing the tube portions against their respective end regions such that the facing surfaces of the tube portions are deformed and the tube portions are mechanically secured to the fins.

2. A method as recited in claim 1 wherein the tube portions and the elbow are integrally formed as a continuous serpentine tube.

3. A method as recited in claim 1 wherein the inserting step includes inserting an expansion tool into the aggregate passage between the tube portions.

4. A method as recited in claim 3 wherein the inserting and expanding steps occur within one cycle of an assembly device that simultaneously inserts the expansion tool and the tube portions into the aggregate passage, and the expanding step occurs as the expansion tool is withdrawn from the aggregate passage.

5. A method as recited in claim 3 wherein the expanding step includes expanding a working end of the expansion tool with a wedge disposed at the working end.

6. A method as recited in claim 1 wherein the expanding step causes only the tube portions to be deformed.

7. A method as recited in claim 1 wherein the expanding step causes each of the tube portions to have a substantially D-shaped cross-section.

8. A method as recited in claim 1 wherein the step of forming the tube portions includes providing at least one of the tube portions with a second elbow oppositely disposed from the elbow, the second elbow having a width greater than the lateral width of the intermediate region of the apertures so as to prevent insertion of the second elbow through the apertures.

9. A method for joining a serpentine tube to a fin pack so as to form a heat exchanger unit, the method comprising the steps of:

forming fins for assembly with the serpentine tube such that apertures are formed in each fin, each of the apertures having an oblong shape defining an intermediate region and oppositely-disposed end regions, each aperture having a lateral width at each of the end regions that is wider than a lateral width at the intermediate region;

forming the serpentine tube to have pairs of tube members, wherein each pair of tube members comprises substantially straight tube portions, the tube portions of each pair of tube members having a first elbow therebetween, the first elbow having a width less than the lateral width of the intermediate region of the apertures, at least one of the tube portions of each pair of tube members communicating fluidically with a tube portion of an adjacent pair of tube members with a second elbow, the second elbow having a width greater than the lateral width of the intermediate region of the apertures so as to prevent insertion of the second elbow through the apertures, the pairs of tube members and first and second elbows defining a continuous fluidic passage of the serpentine tube;

arranging the fins to form the fin pack such that the apertures of the fins are aligned to form aggregate passages through the fin pack;

inserting a corresponding one of the pairs of tube members into each of the aggregate passages such that the first elbow enters the aggregate passage first and such that each of the tube portions is received within a corresponding one of the end regions of each of the apertures, the tube portions of each pair of tube members having facing surfaces within the aggregate passages; and externally expanding the tube portions against their respective end regions by forcing the tube portions against their respective end regions such that the facing surfaces of the tube portions are deformed and the tube portions are mechanically secured portions to the fins.

10. A method as recited in claim 9 wherein the tube portions and the first and second elbows are integrally formed.

11. A method as recited in claim 9 wherein the inserting step includes inserting an expansion tool into each of the aggregate passages between the tube portions.

12. A method as recited in claim 11 wherein the inserting and expanding steps occur within one cycle of an assembly device that simultaneously inserts the expansion tools and the pairs of tube members into the aggregate passages, and the expanding step occurs as the expansion tools are withdrawn from the aggregate passages.

13. A method as recited in claim 11 wherein the expanding step includes expanding a working end of the expansion tool with a wedge disposed at the working end.

14. A method as recited in claim 9 wherein the expanding step causes only the tube portions to be deformed.

15. A method as recited in claim 9 wherein the expanding step causes each of the tube portions to have a substantially D-shaped cross-section.

16. A method as recited in claim 9 wherein the step of forming the serpentine tube includes forming the tube portions and the second elbows to have a substantially circular cross-section.

17. A method for joining a serpentine tube to a fin pack so as to form a heat exchanger unit, the method comprising the steps of:

forming fins for assembly with the serpentine tube such that apertures are formed in each fin, each of the apertures having an oblong shape defining a rectangular intermediate region and oppositely-disposed circular end regions, each aperture having a lateral width at each of the end regions that is wider than a lateral width at the intermediate region;

forming the serpentine tube to have pairs of tube members wherein each pair of tube members comprises substantially straight tube portions, the tube portions of each pair of tube members being integrally formed with a first elbow having a width less than the lateral width of the intermediate region of the apertures, at least one of the tube portions of each pair of tube members being integrally formed with a second elbow to a tube portion of an adjacent pair of tube members, the second elbow having a width greater than the lateral width of the intermediate region of the apertures so as to prevent insertion of the second elbow through the apertures, the pairs of tube members and first and second elbows defining a continuous fluidic passage of the serpentine tube;

arranging the fins to form the fin pack such that the apertures of the fins are aligned to form aggregate passages through the fin pack;

inserting an expansion tool and a corresponding one of the pairs of tube members into each of the aggregate passages, such that the expansion tool is between the tube portions of each of the pairs of tube members, the first elbow enters the aggregate passage first and each of the tube portions is received within a corresponding one of the end regions of each of the apertures, the tube portions of each pair of tube members having facing surfaces within the aggregate passages; and externally expanding the tube portions against their respective end regions by expanding and withdrawing the expansion tools from the aggregate passages so as to mechanically secure the tube portions to the fins, the expansion tools forcing the tube portions against their respective end regions such that the facing surfaces of the tube portions are deformed and each of the tube portions has a substantially D-shaped cross-section.

18. A heat exchanger comprising:

fins having an aperture formed therein, each of the apertures having an oblong shape defining an intermediate region and oppositely-disposed end regions, each aperture having a lateral width at each of the end regions that is wider than a lateral width at the intermediate region, the fins being arranged to form a fin pack such that the apertures of the fins are aligned to form an aggregate passage through the fin pack;

tubing having a pair of substantially parallel tube portions with an elbow therebetween, the elbow having a width less than the lateral width of the intermediate region of the apertures, the tube portions and elbow defining a continuous fluidic passage, the tube portions being disposed in the aggregate passage such that each of the tube portions is received within a corresponding one of the end regions of each of the apertures, the tube portions having facing surfaces within the aggregate passage, the tube portions being externally expanded against their respective end regions such that the facing surfaces of the tube portions are deformed and the tube portions are mechanically secured to the fins.

19. A heat exchanger as recited in claim 18 wherein the tube portions and the elbow are integrally formed as a serpentine tube.

20. A heat exchanger as recited in claim 18 wherein only the tube portions are deformed.

21. A heat exchanger as recited in claim 18 wherein the tube portions to have a substantially D-shaped cross-section.

22. A heat exchanger as recited in claim 18 wherein at least one of the tube portions includes a second elbow oppositely disposed from the elbow, the second elbow having a width greater than the lateral width of the intermediate region of the apertures.

23. A heat exchanger as recited in claim 22 wherein the tube portions and the second elbow have substantially circular cross-sections.

24. A heat exchanger as recited in claim 22 wherein the tube portions are aligned in rows and columns, and there are more than two tube portions in each of the rows and columns.

25. A heat exchanger comprising:

a fin pack comprising fins, each fin having apertures formed therein, each of the apertures having an oblong shape defining an intermediate rectangular region and oppositely-disposed circular end regions, each aperture having a lateral width at each of the circular end regions that is wider than a lateral width at the intermediate rectangular region, the fins being arranged to form the fin pack such that the apertures of the fins are aligned to form aggregate passages through the fin pack;

serpentine tubing having substantially parallel tube portions arranged to form pairs of tube portions, a first elbow being disposed between the tube portions of each pair of tube portions, second elbows being disposed between pairs of tube portions, the tube portions and first and second elbows defining a continuous fluidic passage, each of the first elbows having a width less than the lateral width of the intermediate rectangular region of the apertures, each of the second elbows having a width greater than the lateral width of the intermediate rectangular region of the apertures, each of the pairs of tube portions being disposed in a corresponding one of the aggregate passages such that each of the tube portions is received within a corresponding one of the circular end regions of each of the apertures, the tube portions having facing surfaces within the aggregate passages, the tube portions being expanded against their respective circular end regions such that the facing surfaces of the tube portions are deformed so as to impart a D-shaped cross-section to the tube portions and the tube portions are mechanically secured to the fins.

26. A heat exchanger as recited in claim 25 wherein the tube portions and the second elbow have substantially circular cross-sections.

27. A heat exchanger as recited in claim 25 wherein the tube portions are aligned in rows and columns, and there are more than two tube portions in each of the rows and columns.

* * * * *